US007484488B2

(12) United States Patent
Cecur et al.

(10) Patent No.: US 7,484,488 B2
(45) Date of Patent: Feb. 3, 2009

(54) DUAL VALVE LIFT BLIP WITH SINGLE CAM LOBE FOR GASOLINE ENGINES

(75) Inventors: Majo Cecur, Turin (IT); Kynan L. Church, Battle Creek, MI (US)

(73) Assignee: Eaton Corporation, Cleveland, OH (US)

( * ) Notice: Subject to any disclaimer, the term of this patent is extended or adjusted under 35 U.S.C. 154(b) by 13 days.

(21) Appl. No.: 11/603,737

(22) Filed: Nov. 22, 2006

(65) Prior Publication Data

US 2007/0151534 A1 Jul. 5, 2007

(30) Foreign Application Priority Data

Nov. 25, 2005 (EP) ..... 05257265

(51) Int. Cl.
*F01L 1/14* (2006.01)

(52) U.S. Cl. ..... 123/90.48; 123/90.52; 74/569

(58) Field of Classification Search ..... 123/90.48, 123/90.52, 90.55, 90.44, 90.6; 74/567, 569
See application file for complete search history.

(56) References Cited

U.S. PATENT DOCUMENTS 6,076,491 A * 6/2000 Allen ..... 123/90.16

* cited by examiner

*Primary Examiner*—Ching Chang
(74) *Attorney, Agent, or Firm*—Anna M. Shih

(57) ABSTRACT

A tappet assembly includes a first follower engaging a cam lobe profile, and a second follower engaging an engine poppet valve. A latch member is operable to fix the first follower in an extended position, to provide a high lift condition. The first and second followers define first and second stop surfaces, respectively, such that when the latch member is retracted, the lift portion engages the first follower and moves it toward the poppet valve until the stop surfaces engage, and thereafter, further downward movement of the first follower moves the second follower to provide a low lift. One benefit of this feature is to prevent accumulation of unburned fuel in a port fuel injection type of gasoline engine.

8 Claims, 5 Drawing Sheets

DUAL VALVE LIFT BLIP WITH SINGLE CAM LOBE FOR GASOLINE ENGINES

CROSS-REFERENCE TO RELATED APPLICATIONS

This application claims priority, under 35 U.S.C. 119, of earlier-filed EPO Application No. 05257265.8, filed Nov. 25, 2005.

BACKGROUND OF THE DISCLOSURE

The present invention relates to tappets for use in internal combustion engines, to transmit motion directly from a cam lobe profile of an engine cam shaft to an engine poppet valve. Thus, the present invention relates to engine valvetrain of the "direct acting" type.

Although the improved tappet of the present invention could be utilized in various types of engines, in terms of the type of fuel utilized by the engine, the present invention is especially advantageous when used in a gasoline engine with Port Fuel Injection of the type utilizing intake valve deactivation for one of a pair of intake poppet valves. The invention is even more advantageous in an engine valve control system of the type described above which is utilized for "swirl" control, as that term is now well understood by those skilled in the engine art.

In terms of the type of lift imparted to the engine poppet valve in a direct acting valve train, there are two general categories of such tappets. The first is the conventional mechanical or hydraulic tappet ("bucket tappet") which receives its input from a single cam lobe profile and therefore, imparts only a single "valve event" to the engine poppet valve. The second category comprises "dual lift" tappets of the general type illustrated and described in U.S. Pat. No. 5,193,496. In dual lift tappets of the type taught in the '496 patent, the tappet includes a central portion and an outer portion with the central portion engaging a low lift cam, to produce a low lift valve event, and the outer portion of the tappet engaging a pair of high lift cam lobe profiles to provide a high lift valve event. Thus, the known, prior art dual lift direct acting tappet typically has associated therewith three separate cam lobe profiles (one low lift, and two high lift), making such an arrangement extremely expensive to manufacture and difficult to package.

The improved tappet, and improved valve control system of the present invention was developed in connection with an effort to improve what is referred to as the "charge motion" (i.e., the flow pattern of the air-fuel mixture after it flows past the intake poppet valve). Specifically, the effort was to increase the charge motion at low to medium engine speeds, on gasoline engines utilizing port fuel injection. It was believed that a dual lift tappet arrangement was needed for this particular application, although for the reasons discussed previously, it was clearly not acceptable to require three, or even two, separate cam lobe profiles for each intake poppet valve, merely to achieve the desired dual lift valve event for each intake poppet valve.

It was also determined during the course of development of the present invention that for this particular type of engine application, utilizing port fuel injection, it would not be acceptable for the dual lift tappet to provide, selectively, either a normal lift ("high lift") valve event, or a deactivated valve event. During the low speed operation of the engine, with one of the two intake poppet valves deactivated, it was observed that because of the fuel being injected directly into the intake port, a quantity of fuel would accumulate behind the deactivated valve, over a period of time. Then, once that particular intake poppet valve would again be operated in the normal lift mode, the quantity of fuel which had accumulated would be drawn into the combustion chamber, and could result in an uncontrolled combustion condition. Such an uncontrolled combustion condition could lead to various operating problems of the engine, such as extra, undesirable emissions and NVH ("noise-vibration-harshness") type conditions.

BRIEF SUMMARY OF THE INVENTION

Accordingly, it is an object of the present invention to provide an improved tappet and an improved valve control system for use on intake engine poppet valves, wherein the improved tappet and valve control system overcome the above-described problems of the prior art.

It is a more specific object of the present invention to provide such an improved tappet and improved valve control system such that the intake poppet valve can operate in either a normal lift mode or in another mode which is at least able to prevent the accumulation resulting from the operation of a port fuel injection system.

It is a related object of the present invention to provide an improved tappet and improved valve control system which accomplishes the above-stated objects, but without the need for multiple cam lobe profiles to achieve the multiple lift conditions of each intake poppet valve.

The above and other objects of the invention are accomplished by the provision of a tappet for use in an internal combustion engine including an engine poppet valve and a camshaft having a cam lobe profile including a base circle portion and a lift portion. The tappet is operably disposed between the cam lobe profile and the engine poppet valve. The tappet comprises an inverted, cup-shaped first follower adapted for engagement with the cam lobe profile, and an upright, cup-shaped second follower disposed for reciprocable movement within the first follower, and adapted for engagement with the engine poppet valve. A lost motion spring is operably associated with the first and second followers, and biases the first follower toward an extended position, relative to the second follower and into engagement with the base circle portion of the cam lobe profile.

The improved tappet is characterized by a latching mechanism operably associated with the second follower and including a latch member moveable between a retracted, disengaged position and an extended, engaged position, engaging the first follower to fix the first follower in the extended position, relative to the second follower, and to provide a high lift of the engine poppet valve. The first and second followers define aligned first and second stop surfaces, respectively, disposed such that when the latch member is in the retracted, disengaged position, engagement of the lift portion of the cam lobe profile with the first follower moves the first follower toward the engine poppet valve. This movement of the first follower compresses the lost motion spring until the first stop surface engages the second stop surface, and thereafter, further movement of the first follower moves the second follower to provide a low lift of the engine poppet valve.

DETAILED DESCRIPTION OF THE PREFERRED EMBODIMENT

Figure 1:
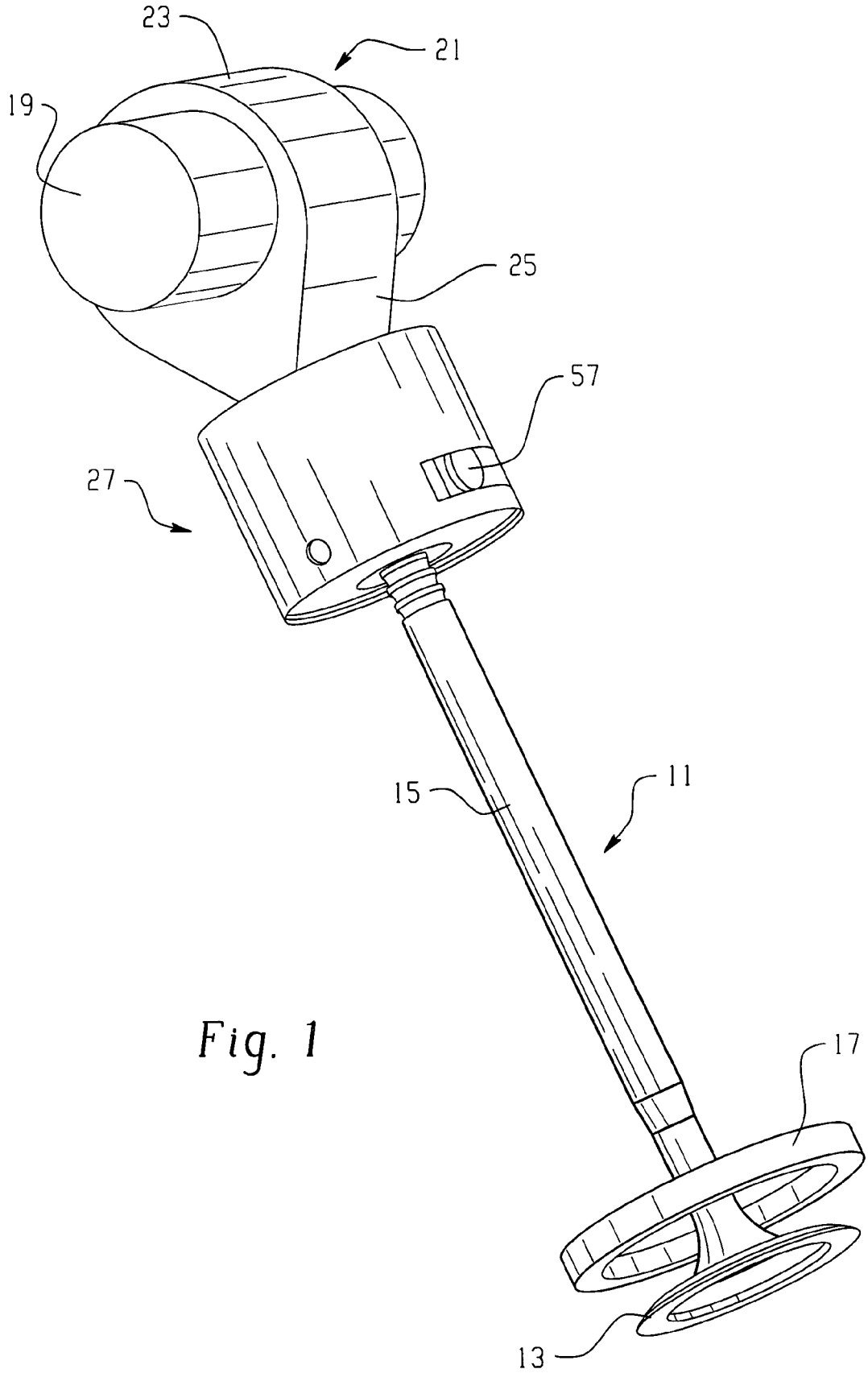
FIG. 1 is a perspective view of a portion of a valve control system utilizing the tappet of the present invention.

Referring now to the drawings, which are not intended to limit the invention, FIG. 1 is a simplified perspective view of a valve control system of the type to which the present invention relates, and which is typically referred to as being of the "direct acting" type. In the valve control system shown in FIG. 1, there is an engine poppet valve generally designated 11 including a head portion 13 and a valve stem 15. Received within the cylinder head (not shown) is a valve seat insert 17 such that, when the engine poppet valve 11 is in the closed position, the head portion 13 is seated against the valve seat insert 17 in a manner well known to those skilled in the art of internal combustion engines. Thus, in FIG. 1, the engine poppet valve 11 is illustrated in a fully open condition (to be referred to subsequently as a "high lift" condition).

Opening and closing motion is transmitted to the engine poppet valve 11 by means of a camshaft 19 on which is formed a cam lobe 21 having a cam lobe profile (which will also hereinafter bear the reference numeral "21"), including a base circle portion 23 and a lift portion 25. Disposed between the cam lobe profile 21 and the engine poppet valve 11 is a tappet assembly, generally designated 27.

Figure 2:
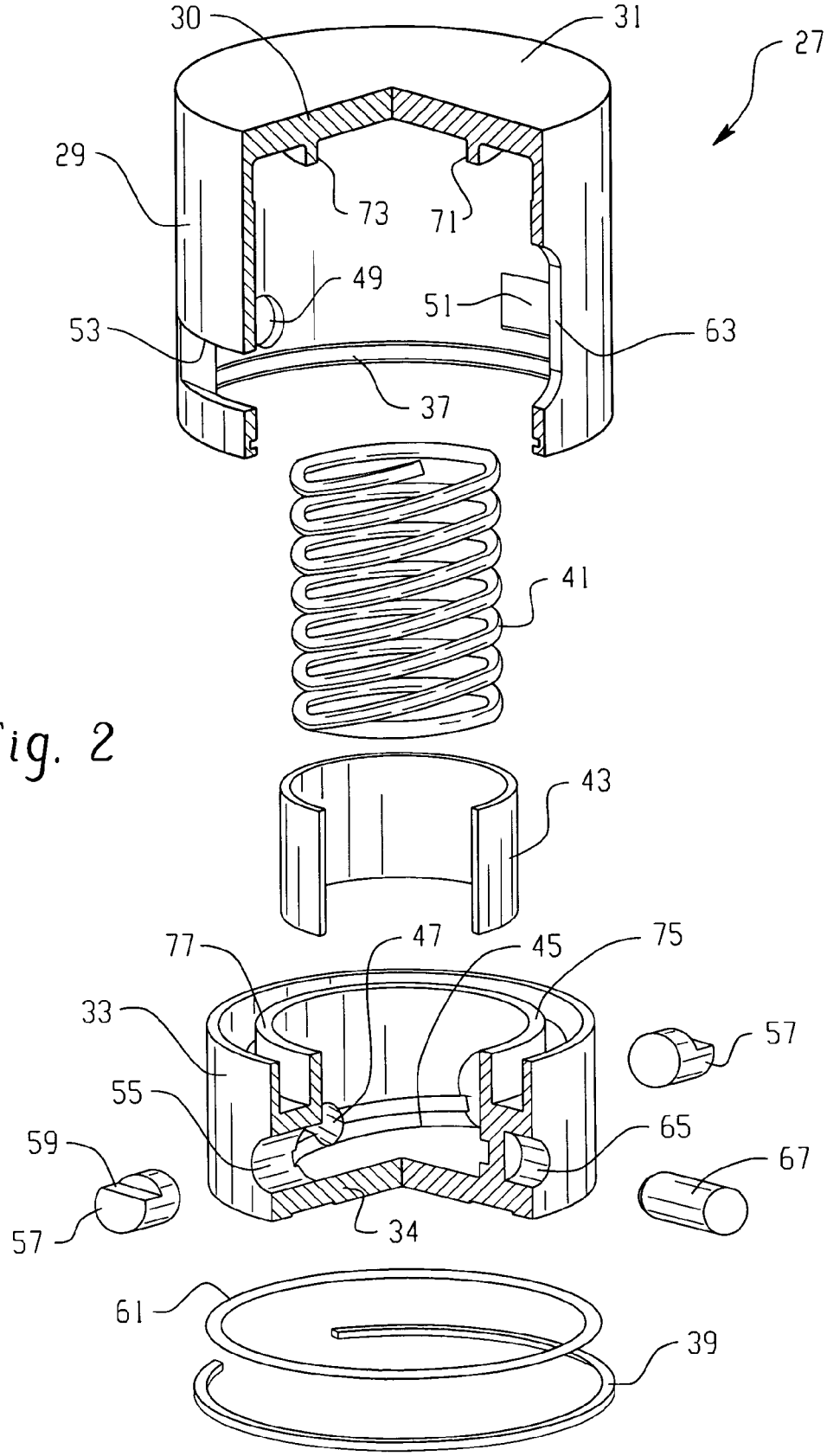
FIG. 2 is a partially broken-away, exploded, perspective view of the improved tappet of the present invention.
Figure 3:
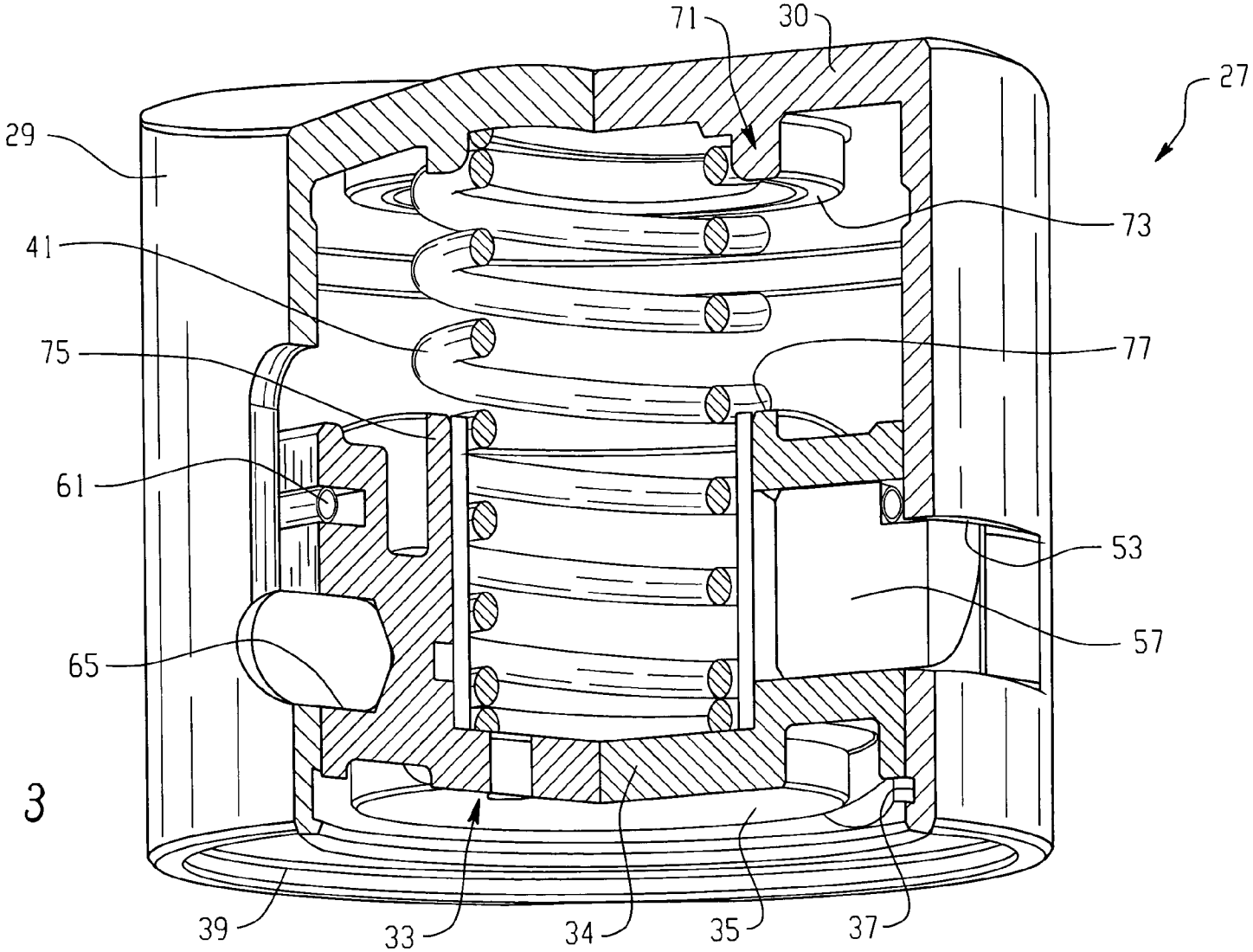
FIG. 3 is a partially broken-away, assembled perspective view of the improved tappet of the present invention.

Referring now primarily to FIG. 2, but also to FIG. 3, the tappet assembly 27 comprises an outer follower 29 which, in the subject embodiment, and by way of example only, comprises an inverted (i.e., opening "downward" in its normal orientation), cup-shaped element. The outer follower 29 includes an "upper" wall portion 30 providing an upper follower surface 31, adapted to be in substantially constant engagement with the cam lobe profile 21.

The tappet assembly 27 also includes an inner follower 33 which is preferably disposed for reciprocable movement within the outer follower 29. As may best be seen in FIG. 3, the inner follower 33 includes a lower wall portion 34 which defines, on its underside, a valve tip surface 35. Preferably, the inner follower 33 is also generally cup-shaped, but unlike the outer follower 29, the inner follower 33 preferably opens upwardly as is shown in FIG. 2. It will be understood that, as used herein, the terms "upper" and "lower", and words of similar import should not be construed as limitations on the invention, but instead, as merely explanatory, assuming the tappet assembly is in its normal operating position, as shown in FIG. 1.

The cylindrical wall of the outer follower 29 defines, on the inside surface thereof, an annular groove 37 and disposed therein, when the tappet assembly 27 is fully assembled, is a stopping retainer 39, which may be in the general form of a C-clip, as is also visible in FIG. 3. Disposed axially between the upper wall portion 30 of the outer follower 29, and the lower wall portion 34 of the inner follower 33, is a coiled compression spring 41, the function of which is to bias the outer follower 29 away from the inner follower 33 to an extended position as shown in FIG. 3. This extended position shown in FIG. 3 would correspond to the condition when the upper follower surface 31 is in engagement with the base circle portion 23 of the cam lobe 21. The extended position of the outer follower 29, relative to the inner follower 33, is determined by the location of the stopping retainer 39.

Surrounding the coiled compression spring 41 is an oil passage wall member 43, which preferably comprises a thin piece of steel or other metal. The inner follower 33 defines an internal annular groove 45 (see FIG. 2) which receives pressurized fluid by means of an oil feed passage 47. Once the oil passage wall member 43 is put in place within the inner follower 33, the internal annular groove 45 is "closed" and comprises an annular pressure chamber, receiving pressurized fluid through the oil feed passage 47 whenever it is desired to operate the tappet assembly 27 in a latched condition, to be described subsequently. Pressurized fluid enters the oil feed passage 47 in the inner follower 33 by means of a fluid port 49 formed in the cylindrical wall of the outer follower 29, as is shown in FIG. 2.

Referring still primarily to FIG. 2, the cylindrical wall of the outer follower 29 defines a plurality of latch windows 51, each of which includes an upper arcuate latch surface 53 (best seen in FIG. 3). The inner follower 33 defines a plurality (corresponding to the number of latch windows 51) of radial latch bores 55, and disposed in each latch bore 55 is a cylindrical latch member 57 defining a planar latch surface 59. As is well known to those skilled in the engine component art, the latch member 57 is normally (in the absence of pressurized fluid in the fluid port 49) held in a retracted, disengaged position by means of a return spring 61, the location of which may best be seen by reference to FIG. 3.

Referring still primarily to FIG. 2, the cylindrical wall of the outer follower 29 defines a vertically oriented slot 63 and the inner follower 33 defines a bore 65. Received within the bore, and preferably, in a press-fit relationship therein, is an orientation pin 67, the outer end of the pin 67 being received within the vertically-oriented slot 63. Thus, the rotational position of the outer follower 29, relative to the inner follower 33 is fixed (to be non-rotatable), while relative axial movement is permitted with the outer end of the orientation pin 67 moving vertically within the slot 63, in a manner well known to those skilled in the art.

The upper wall portion 30 of the outer follower 29 includes an annular, raised portion 71, which is preferably formed integrally with the outer follower 29. The annular portion 71 defines, on its underside, an annular stop surface 73. Similarly, the inner follower 33 defines an annular, upstanding portion 75 including, on the upper side thereof, an annular stop surface 77. Preferably, the annular portion 71 and the annular portion 75 have approximately the same inner and outer diameters, such that the annular stop surfaces 73 and 77 are, under the appropriate operating circumstances, disposed to be in a face-to-face, engaging relationship, as will be described in greater detail subsequently. Preferably, and as may best be seen in FIG. 3, the compression spring 41 is selected such that its outer diameter is just slightly less than the inner diameter of the annular portion 71 and of the annular portion 75. As a result, during relative axial movement of the followers 29 and 31, the compression spring 41 is supported by, and contained within, the annular portions 71 and 75.

When the valve control system of the present invention is operating in the base circle mode, the coiled compression spring 41 maintains the upper follower surface 31 in engagement with the base circle portion 23 while the valve tip surface 35 remains in engagement with the stem tip of the valve stem 15 of the engine poppet valve 11, in a manner well known to those skilled in the art.

When it is desired to operate the tappet assembly 27 in a normal lift ("high lift") mode, pressurized control fluid is communicated to the fluid port 49 and from there flows through the oil feed passage 47, filling the annular groove 45.

The annular groove 45 is in open communication with each of the radial latch bores 55, such that the presence of control pressure in the annular groove 45 will bias the latch members 57 radially outward from their retracted, disengaged positions to their extended, engaged positions, in opposition to the biasing force of the return spring 61. When the latch members 57 are in the latched position, with the latch surface 53 of the outer follower 29 engaged by the latch surface 59 of the latch member 57, the outer follower 29 and the inner follower 33 are latched in a fixed axial position relative to each other as shown in FIG. 3. In the latched condition just described, the outer follower 29 is being maintained in its extended position, relative to the inner follower 33, as shown in FIG. 3. In this extended position, when the camshaft 19 rotates such that the lift portion 25 of the cam lobe 21 engages the upper follower surface 31, such engagement causes the tappet assembly 27 to move "downward" as a solid unit, thus causing corresponding downward movement of the engine poppet valve 11 from its normally closed position to the fully open "high lift" position (i.e., the position of the engine poppet valve 11 shown in FIG. 1), in opposition to the biasing force of a valve return spring (not shown herein). The operation of the tappet assembly 27 in the latched condition, as just described, results in the "High Lift" curve shown in FIG. 4.

In accordance with an important aspect of the present invention, when it is desired to operate the valve control system of the present invention in what is nominally a "deactivated" condition, the control pressure normally communicated to the fluid port 49 is discontinued (such as by draining it to a system reservoir, or low pressure location), thus reducing the fluid pressure within the annular groove 45. In the absence of pressurized control fluid, the return spring 61 biases the latch members 57 toward their retracted, disengaged position, such that the latch surfaces 59 are no longer in engagement with the latch surfaces 53. When the tappet assembly 27 is operating in the above-described unlatched, disengaged condition, engagement of the base circle portion 23 with the upper follower surface 31 will result in the tappet assembly 27 being in its fully extended position shown in FIG. 3. However, as the camshaft 19 continues to rotate, the lift portion 25 will engage the upper follower surface 31, and begin to move the outer follower 29 "downward" (i.e., in a direction toward the engine poppet valve 11).

As should be well understood by those skilled in the internal combustion engine art, the biasing force of the compression spring 41 is substantially less than the biasing force of the valve return spring (not shown herein) for the engine poppet valve 11. Therefore, as the lift portion 25 of the cam lobe 21 moves the outer follower 29 downward, the compression spring 41 will begin to be compressed, but there will be no corresponding, downward movement of the engine poppet valve 11.

As the camshaft 19 continues to rotate, with the lift portion 25 of the cam lobe 21 approaching what would normally be the "peak" of its lift, the outer follower 29 merely continues to move downward, compressing the compression spring 41, until such time as the annular stop surface 73 engages the annular stop surface 77. The above-described contact of the stop surfaces 73 and 77 occurs at approximately −15° of cam angle in the graph of FIG. 4. As the camshaft 19 continues to rotate (beyond the −15° shown in FIG. 4), with the stop surfaces 73 and 77 in engagement, the engagement of the peak part of the lift portion 25 with the upper follower surface 31 will again cause the tappet assembly 27 to operate as a solid unit, but now, in a low lift condition ("blip" mode) represented by the "Low Lift" curve shown in FIG. 4. The term "blip" is used to indicate that the low lift condition of the present invention, when compared to the normal, high lift condition, results in a valve lift which is merely a small portion of the high lift, both in terms of lift amount (millimeters) and lift duration (degrees of cam rotation). By way of example only, in the engine on which the present invention was developed, the high lift was approximately 8.0 mm., whereas the low lift (blip) was about 0.5 mm. Also, the duration of the high lift was about 140° of cam angle, whereas the low lift was about 30° of cam angle.

Figure 4:
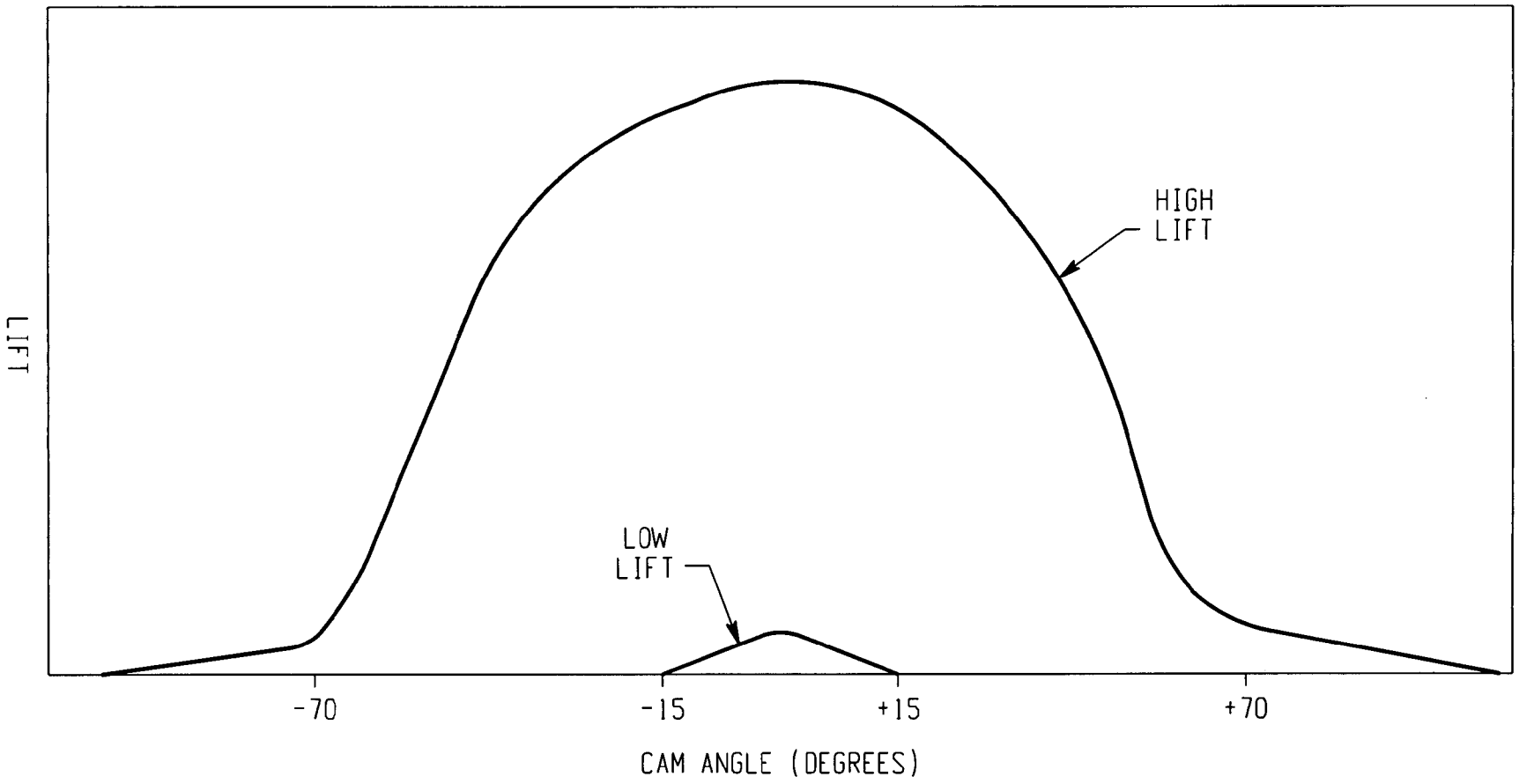
FIGS. 4 and 5 are graphs of Lift and of cam profile velocity, respectively, as a function of Cam Angle (in degrees), illustrating the operation of the improved tappet and the improved valve control system of the present invention.

Once the lift portion 25 of the cam lobe 21 reaches approximately +15°, as shown in FIG. 4, the compression spring 41 biasing the outer follower 29 upward will cause the stop surface 73 to disengage from the stop surface 77, and thereafter, with continued rotation of the camshaft 19, the outer follower 29 will return to the extended position shown in FIG. 3. In this condition, the poppet valve 11 is permitted, under the influence of its valve return spring, to return to the fully closed position (Low Lift curve, Lift=0), as was the case just before the "blip". As was described in the Background of the Disclosure, the purpose of this small amount (blip) of lift is to permit fuel to pass from the intake into the combustion chamber, rather then accumulating behind the intake poppet valve 11.

Figure 5:
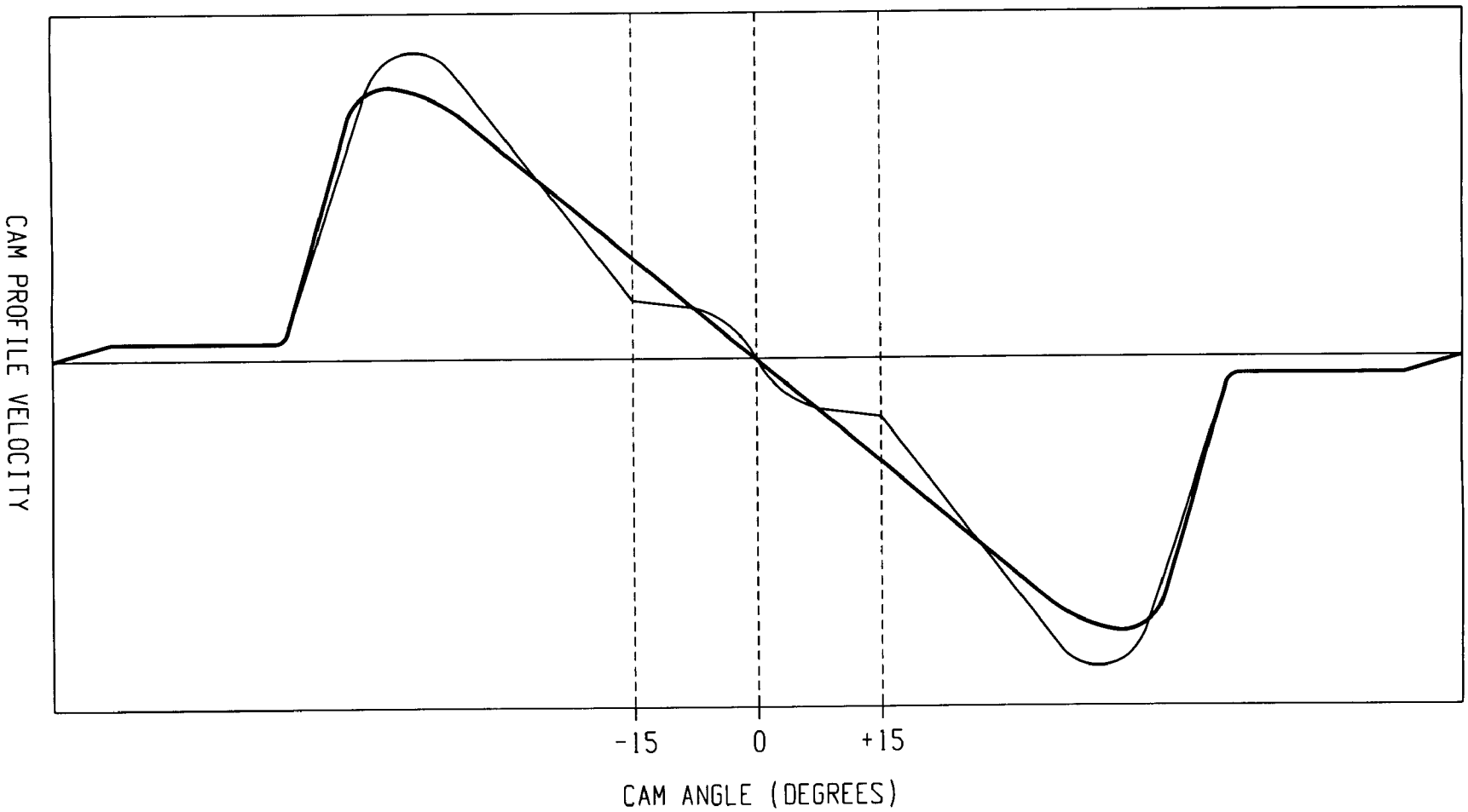

Referring now to FIG. 5, and specifically to the "Velocity" curve, it should be noted that the acceleration of the valve in the low lift (blip) mode is actually a negative quantity. However, just at the −15° of cam rotation, where the blip begins, the velocity (stop surface 77 to stop surface 73 impact velocity) is low, and acceleration is nearly zero, and then increases (in the negative direction) as the poppet valve undergoes the low lift. Then, at the +15° of cam rotation, where the blip ends, the velocity (now valve to valve seat impact velocity) is low again and acceleration is again very nearly zero. This is an important feature of the invention because, if the impact velocity (and acceleration) value were substantially higher than what is shown in FIG. 5, there would likely be very significant durability and NVH (noise-vibration-harshness) issues with the tappet assembly 27 of the present invention.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A tappet for use in an internal combustion engine including an engine poppet valve and a camshaft having a cam lobe profile including a base circle portion and a lift portion, said tappet being operably disposed between said cam lobe profile and said engine poppet valve; said tappet comprising an inverted, cup-shaped first follower adapted for engagement with said cam lobe profile, and an upright, cup-shaped second follower disposed for reciprocable movement within said first follower, and adapted for engagement with said engine poppet valve; a lost motion spring operably associated with said first and second followers and biasing said first follower toward an extended position, relative to said second follower, and into engagement with said base circle portion of said cam lobe profile; said tappet comprising:

(a) a latching mechanism operably associated with said second follower and including a latch member moveable between a retracted, disengaged position and an extended, engaged position engaging said first follower to fix said first follower in said extended position, relative to said second follower and provide a high lift of said engine poppet valve; and (b) said first follower having a first portion defining a first stop surface and said second follower having a second portion defining a second stop surface, the first and second stop surfaces being aligned such that, when said latch member is in said retracted, disengaged position, engagement of said lift portion of said cam lobe profile with said first follower moves said first follower toward said engine poppet valve, compressing said lost motion spring until said first stop surface contacts said second stop surface, and thereafter, further movement of said first follower moves said second follower to provide a low lift of said engine poppet valve.

2. A tappet as claimed in claim 1, wherein said low lift of said engine poppet valve comprises a relatively small portion of said high lift.

3. A tappet as claimed in claim 2, wherein said high lift defines a first event duration and said low lift defines a second event duration, said second event duration comprising a relatively small portion of said first event duration.

4. A tappet as claimed in claim 1, wherein said latching mechanism comprises said second follower and said second follower includes a plurality of said latch members, oriented to move radially, and includes a return spring operable to bias said latch members radially inward to said retracted, disengaged position.

5. A tappet as claimed in claim 4, wherein said second follower defines an annular pressure chamber disposed radially inward of said plurality of said latch members and said first and second followers cooperate to define a fluid passage operable to communicate pressurized fluid to said annular pressure chamber, said pressurized fluid in said annular pressure chamber being operable to bias said latch members radially outward to said extended, engaged position.

6. A tappet as claimed in claim 1, wherein said lost motion spring comprises a coiled compression spring disposed within said first and second annular portions.

7. A tappet as claimed in claim 1, wherein said first portion and said second portion have approximately the same inner and outer diameters.

8. A tappet as claimed in claim 1, wherein said lost motion spring is supported by said first portion and said second portion.

* * * * *